US007959378B2

(12) United States Patent
Ebner et al.

(10) Patent No.: US 7,959,378 B2
(45) Date of Patent: Jun. 14, 2011

(54) BASE FOR A DRILLING DEVICE

(75) Inventors: Bernhard Ebner, Knittelfeld (AT); Peter Kogler, Knittelfeld (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 497 days.

(21) Appl. No.: 11/989,908

(22) PCT Filed: Jul. 26, 2006

(86) PCT No.: PCT/AT2006/000319

§ 371 (c)(1),
(2), (4) Date: Jan. 31, 2008

(87) PCT Pub. No.: WO2007/014410

PCT Pub. Date: Feb. 8, 2007

(65) Prior Publication Data

US 2010/0052405 A1 Mar. 4, 2010

(30) Foreign Application Priority Data

Aug. 3, 2005 (AT) ..... A 1314/2005

(51) Int. Cl.
*E21B 7/00* (2006.01)

(52) U.S. Cl. ..... 405/259.1

(58) Field of Classification Search ..... 299/55, 299/75, 76, 54, 61; 173/192; 405/259.1, 405/288, 290, 291, 138, 139, 294
See application file for complete search history.

(56) References Cited

U.S. PATENT DOCUMENTS

| | | | | | |
|---|---|---|---|---|---|
| 602,309 | A * | 4/1898 | Cryer et al. | 37/190 |
| 1,347,332 | A * | 7/1920 | Hopkinson | 299/67 |
| 1,987,982 | A * | 1/1935 | Wheeler | 299/56 |
| 2,165,404 | A * | 7/1939 | Mitchell | 299/55 |
| 2,166,569 | A * | 7/1939 | Mitchell | 299/55 |
| 2,218,492 | A * | 10/1940 | Osgood | 299/55 |
| 2,334,576 | A * | 11/1943 | Osgood | 299/55 |
| 2,572,403 | A * | 10/1951 | Stevenson | 299/55 |
| 2,692,130 | A * | 10/1954 | Ruth | 299/76 |
| 2,979,320 | A * | 4/1961 | Adams | 173/34 |
| 3,032,325 | A * | 5/1962 | Peterson | 299/67 |
| 3,114,425 | A | 12/1963 | Adams | |
| 3,346,055 | A * | 10/1967 | Young | 173/37 |
| 3,399,734 | A | 9/1968 | Folinsbee | |
| 4,089,100 | A | 5/1978 | Berry, Jr. | |
| 4,098,538 | A * | 7/1978 | Hilton | 299/33 |
| 4,108,494 | A * | 8/1978 | Kogler | 299/1.4 |
| 4,572,303 | A * | 2/1986 | Marechal | 173/39 |
| 4,848,844 | A * | 7/1989 | Weiss | 299/55 |
| 5,330,257 | A | 7/1994 | Wurster | |
| 5,333,937 | A * | 8/1994 | Hopkins | 299/70 |
| 7,357,458 | B2 * | 4/2008 | Hartwig | 299/75 |
| 2005/0129466 | A1 * | 6/2005 | Walker et al. | 405/259.1 |

FOREIGN PATENT DOCUMENTS

| | | |
|---|---|---|
| DE | 1 758 505 | 3/1971 |
| GB | 1 342 998 | 1/1974 |
| GB | 1 352 706 | 5/1974 |

* cited by examiner

*Primary Examiner* — Sunil Singh
(74) *Attorney, Agent, or Firm* — Chapman and Cutler LLP

(57) ABSTRACT

In a starter car for a drilling device for mining underground deposits, including a base frame (5) mounted to rotate about a vertical axis (6) and a starter pipe (7) mounted to pivot about a substantially horizontal axis (13) and provided for receiving the drilling device, the starter pipe (7) is arranged to be displaceable relative to the base frame (5) transversely to the horizontal pivot axis (13).

18 Claims, 5 Drawing Sheets

BASE FOR A DRILLING DEVICE

Figure 1:
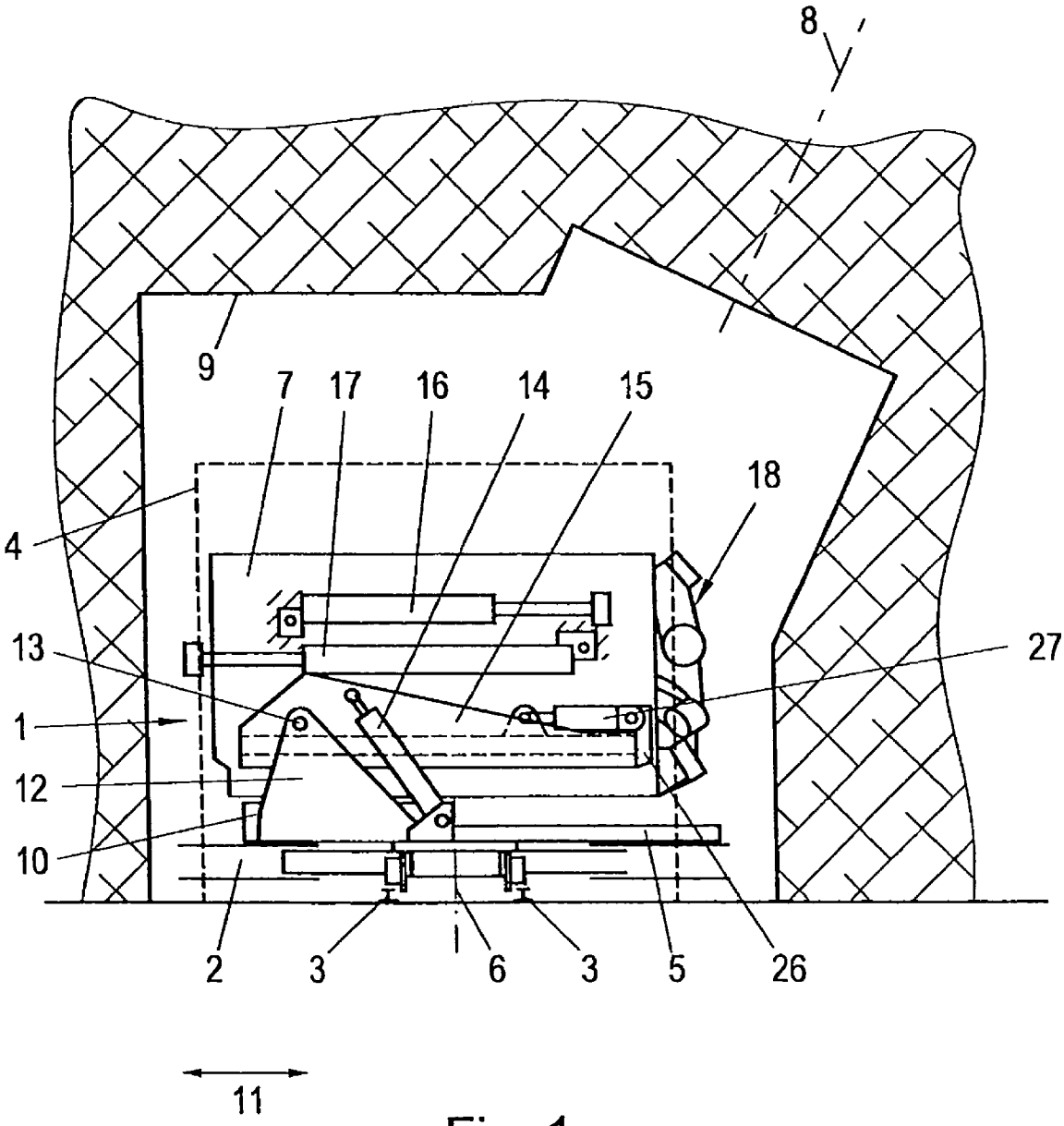

The invention relates to a starter car for a drilling device for mining underground deposits, including a base frame mounted to rotate about a vertical axis and a starter pipe mounted to pivot about a substantially horizontal axis and provided for receiving the drilling device.

For the mining of underground deposits, so-called box-hole boring has become known, in which bores extending laterally obliquely upwards are introduced starting from a driven tunnel. To this end, a suitable drilling device must be conveyed through the driven tunnel to the respective site and subsequently brought into the position corresponding with the desired orientation of the bore. To this end, so-called starter cars have become known, which are movable within the driven tunnel and comprise what is called a starter pipe, in which the drilling device is received and from which the drilling device is driven ahead into the rock or deposit. In that case, the drilling device is initially supported within the starter pipe oriented in correspondence with the desired course of the bore and can then be supported on the borehole wall while successively emerging from the starter pipe and entering into the borehole it produces.

With conventional starter cars, an increased tunnel cross section must be excavated in the region of the desired position of the bore laterally extending upwardly from the driven tunnel, in order to provide sufficient space for maneuvering the starter car. An excavation cross section increased, in particular, in terms of width is particularly required for conventional starter cars in order to pivot the starter pipe by 90° from a position in alignment with the tunnel axis into the drilling plane and, after this, pivot the starter pipe upwards by the aid of a tilting mechanism to thereby bring it into the drilling position. The necessity of an increased excavation cross section is due not only to the structural length of the starter pipe, but, in the event of conventional starter cars, above all to the increased space required for the upward pivotal movement of the starter pipe in order to bring the drilling device into the drilling position.

A starter car is, for instance, known from U.S. Pat. No. 2,979,320, in which the drilling device employed will, however, remain within the starter pipe during the whole drilling procedure as opposed to the above-described machine, with the drill head being connected to the drilling drive via extension elements as a function of the drilling depth.

The present invention aims to improve a starter car of the initially defined kind to the effect that the space required for the positioning of the starter pipe is reduced in the drilling direction and the cross section of the driven tunnel in the region of the desired bore need, thus, to be increased to a smaller extent.

To solve this object, the starter car of the initially defined kind is essentially characterized in that the starter pipe is arranged to be displaceable relative to the base frame transversely to the horizontal pivot axis. By arranging the starter pipe to be not only pivotable in the vertical direction, but also displaceable transversely to the horizontal pivot axis, it has become feasible during the positioning of the starter pipe to perform a combined pivotal and displacement movement, which allows the utilization of the limited size of the excavation cross section in the optimum manner. It may, for instance, be proceeded such that a displacement of the starter pipe in the direction towards the desired bore is effected simultaneously with the upward pivotal movement of the starter pipe. The configuration according to the invention constitutes a substantial enhancement of the application options of the starter car and provides an improved maneuverability while simultaneously allowing compact dimensions of the starter car.

The structural realization of the pivotability and displaceability is preferably provided in a manner that the starter pipe is pivotally fixed to a carriage which is displaceable transversely to the horizontal pivot axis. In this case, a separate carriage is thus provided, on which the pivot bearings for the pivotal movement of the starter pipe are provided. The configuration may, however, also be devised such that, instead of the pivot axis being displaceable, a stationary pivot axis is provided, about which a guide frame is pivotally mounted, in which the starter pipe is displaceably guided. Yet, a combination of the two previously mentioned options is just as well possible, in which case a double displaceability will then be provided and the configuration may be devised such that the guide frame is pivotally mounted on the carriage which is displaceable transversely to the horizontal pivot axis.

In order to further reduce the space required for the pivoting of the starter pipe, it is provided according to a preferred embodiment that the substantially horizontal pivot axis extends below the horizontal central plane of the starter pipe. Depending on the concrete arrangement of the pivot axis, such a configuration will enable to achieve a complete pivoting of the starter pipe even if the axis of rotation is positioned in a particularly low and, hence, space-saving manner.

In order to enable a conventional pivot drive to be provided for the pivoting of the starter pipe despite the displaceability of the starter pipe, the configuration is preferably devised such that the pivot drive for pivoting the starter pipe engages at the displaceable carriage. To this end, conventional cylinder piston units may be employed, which are articulately connected to the displaceable carriage, on the one hand, and to the starter pipe, on the other hand, such that the cylinder piston units are arranged to be displaceable together with the starter pipe, wherein it is merely required to provide the supply and discharge of the pressure fluid for the operation of the cylinder piston units via accordingly flexible ducts.

In order to further enhance the maneuverability, the base frame is advantageously rotationally mounted on a movable main frame. To improve the support of the starter car in the driven tunnel, it is preferably provided that the movable main frame comprises laterally extendible support elements for the vertical support of the starter car. The extendibility of such lateral support elements provides a larger contact zone and, hence, a more stable support of the starter car against the floor. To take up the high forces to be observed during the drilling procedure, the starter pipe too must be appropriately braced within the driven tunnel, and it is therefore preferably provided that the starter pipe comprises support elements, which are extendible in the axial direction of the starter pipe to brace the starter pipe within the road. The support in this case primarily takes place in the axial direction, with an axially extendible support element being adjustable against the roof and a further axially extendible support element being adjustable against the base frame. Such axial support elements will also be able to ensure a lateral support in a simple manner if, as in correspondence with a preferred further development, at least one of the axially extendible support elements comprises supporting struts which are foldable out laterally and pressable against the lateral face.

Figure 2:
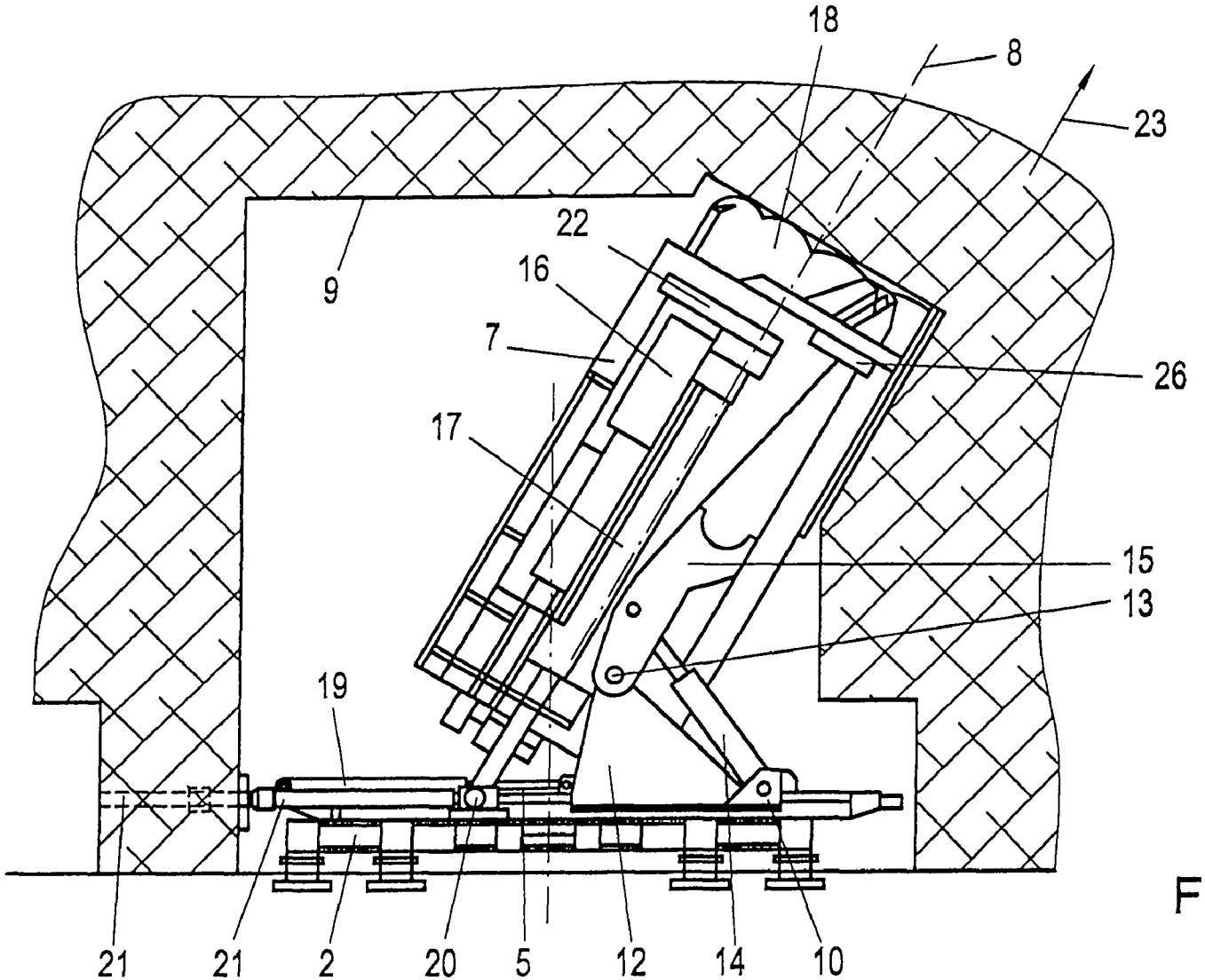
Figure 3:
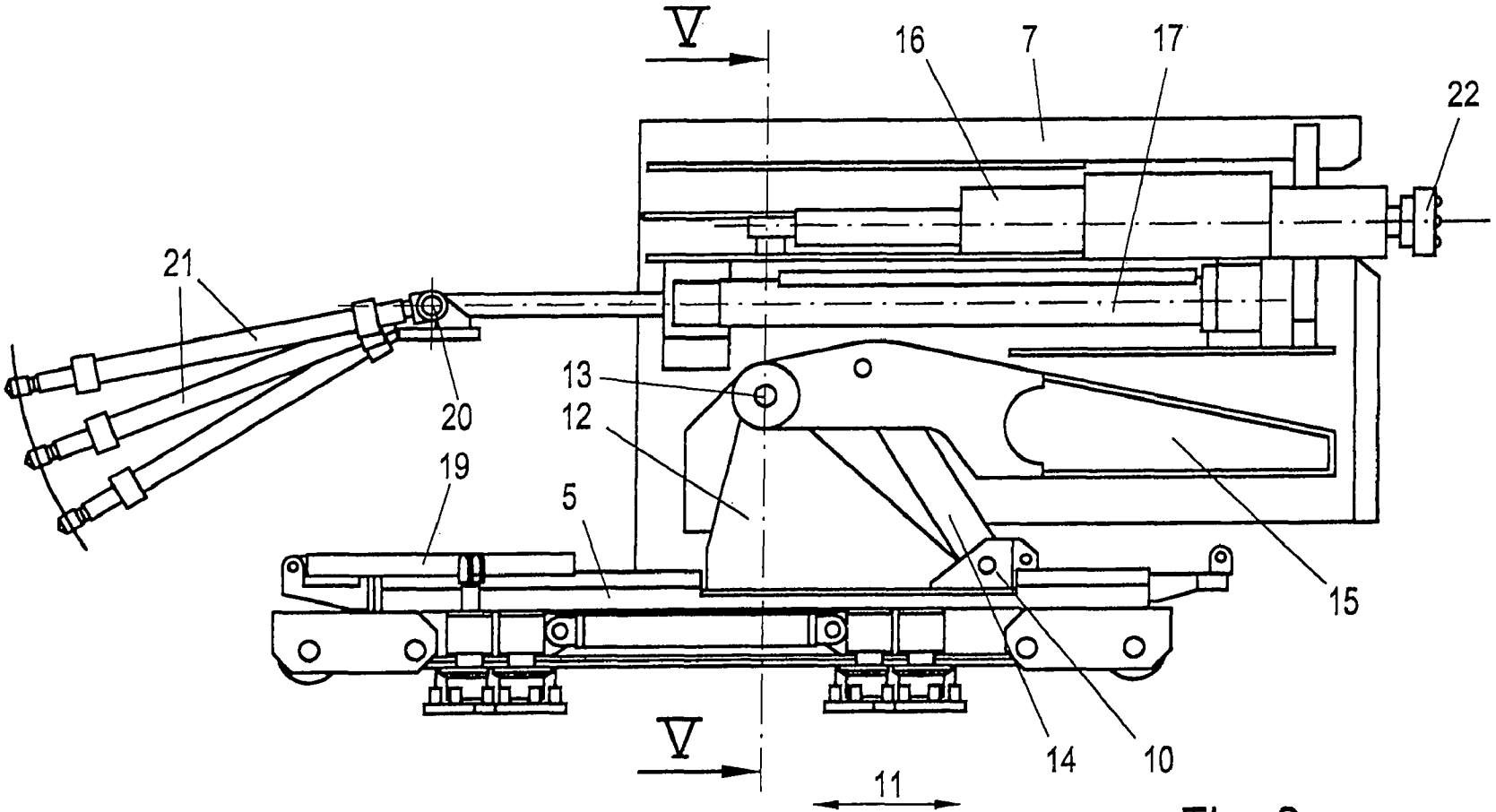
Figure 4:
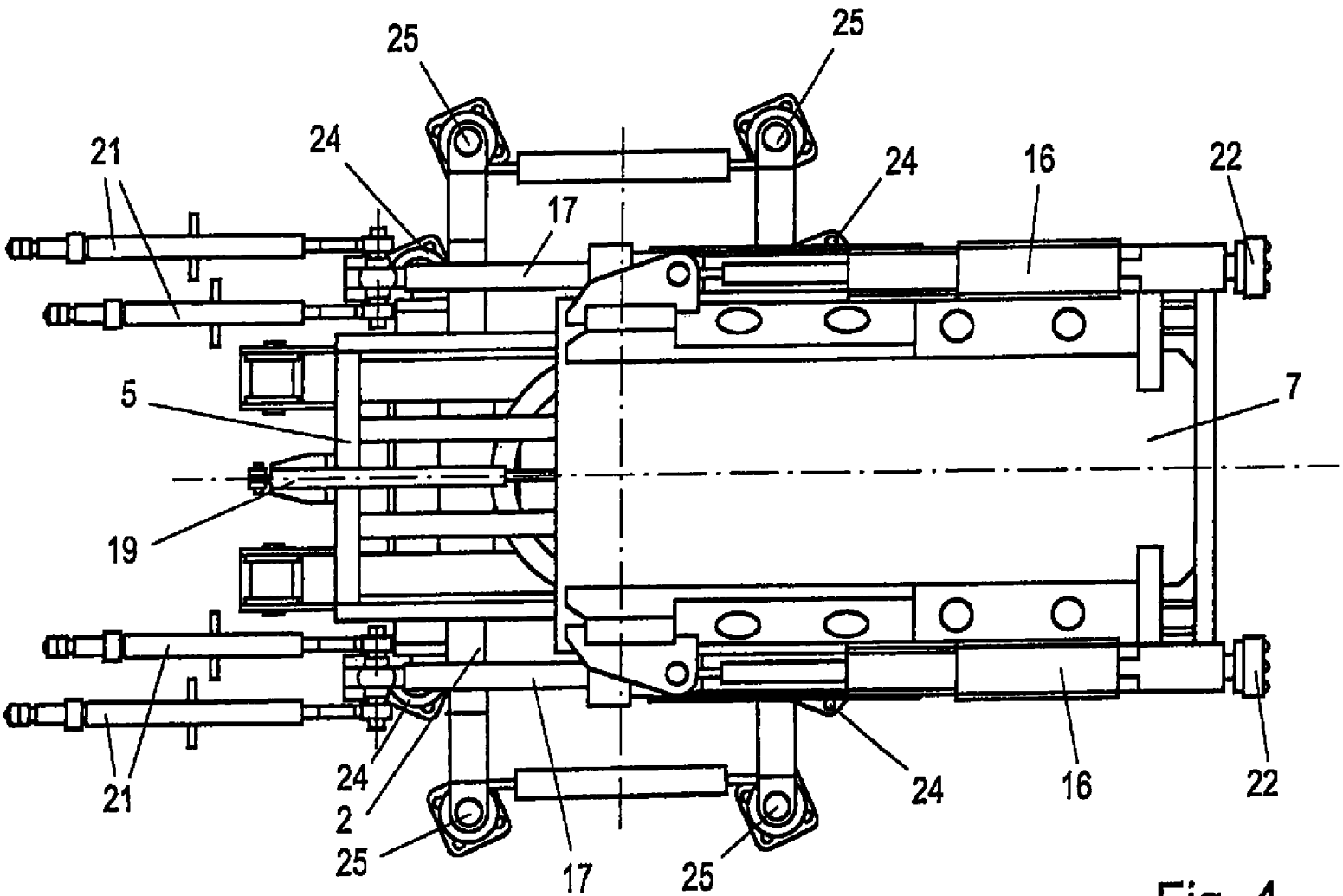
Figure 5:
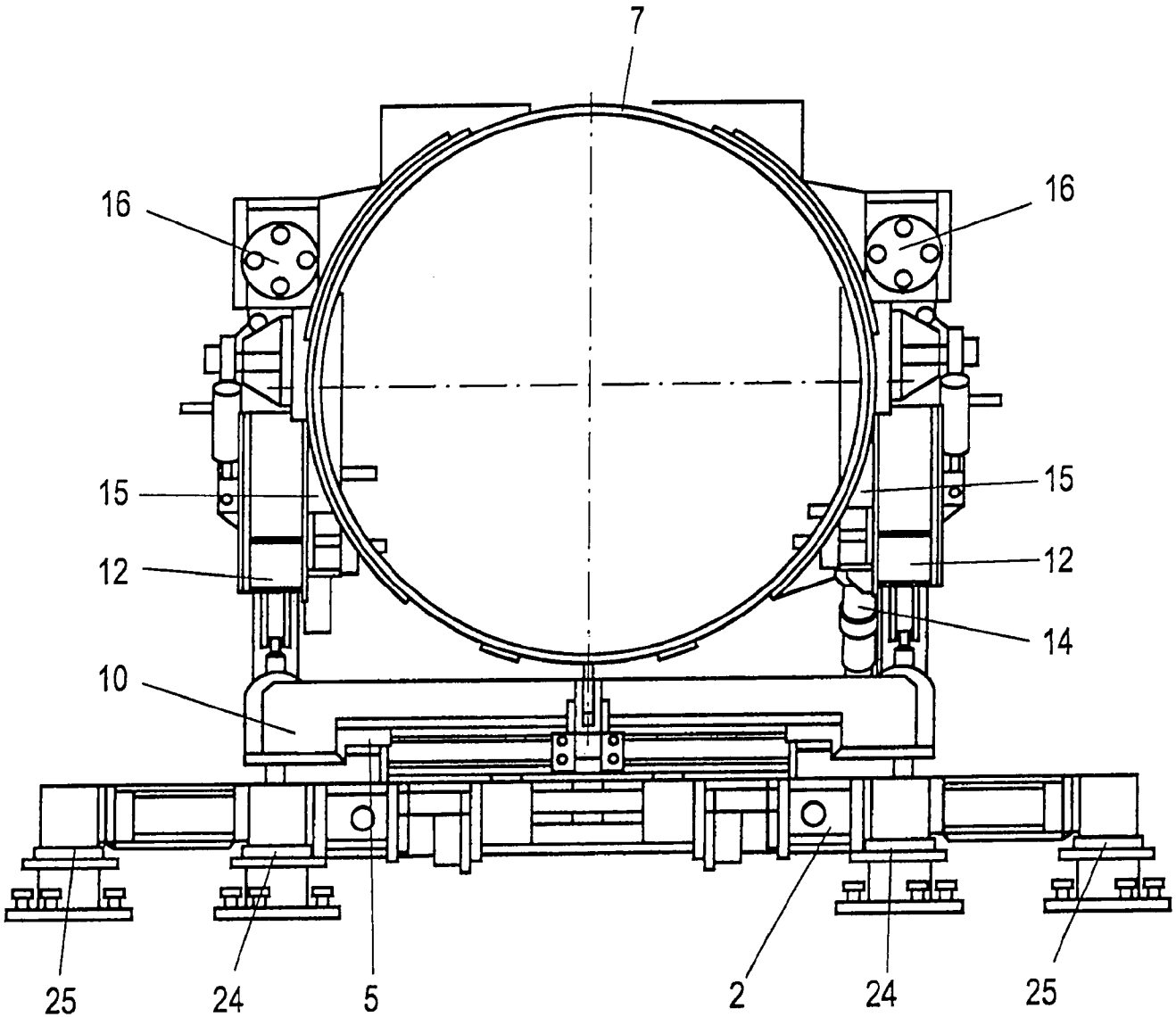

In the following, the invention will be explained in more detail by way of an exemplary embodiment schematically illustrated in the drawing. Therein, FIG. 1 is a side view of the starter car in the starting position; FIG. 2 is a side view of the starter car in the drilling position; FIG. 3 is a further side view of the starter car; FIG. 4 is a top view on the starter car; and FIG. 5 depicts a section along line V-V of FIG. 3.

In FIG. 1 a starter car 1 is shown including a main frame 2, which is movable on rails 3 in the longitudinal direction of a driven track, whose cross section is schematically indicated by 4. A base frame 5 is connected with the main frame 2 so as to rotate about a vertical axis 6, said base frame 5 together with the starter pipe 7 initially having to be arranged in a manner rotated by 90° relative to the position illustrated in FIG. 1, i.e. with the axis of the starter pipe 7 oriented in the longitudinal direction of the driven track, in order to enable the starter car 1 to be moved within the driven track. In the region of the desired bore, whose axis is schematically denoted by 8, an increased excavation has been effected in the driven track, whose cross section is schematically indicated by 9 and which allows the starter pipe 7 to be maneuvered into the drilling position. To this end, the base frame 5, along with the starter pipe 7, is at first rotated by 90° into the position illustrated in FIG. 1 before the starter pipe 7 is pivoted into the drilling position represented in FIG. 2.

A carriage 10 is guided on the base frame 5 in the direction of double arrow 11, said carriage 10 having lateral cheeks 12 including bearing sites for the pivoting of the starter frame 7 about the horizontal pivot axis 13. The pivot axis 13 is arranged in such a manner as to enable the complete pivoting of the starter pipe 7. This means that a pivotal movement by up to 90° is rendered feasible, because the pivot axis 13 is arranged at a distance from the bottom of the carriage 10, that is larger than the distance of the axis of rotation to the lowermost edge point of the support pipe 7 on the left side. The pivot drive in this case is formed by cylinder piston units 14 engaging at the carriage 10, on the one hand, and a guide frame 15, on the other hand. On the guide frame 15, which is mounted so as to be pivotable about the pivot axis 13, the starter pipe 7 is guided to be displaceable in the axial direction of the starter frame so as to enable the starter pipe 7 to be advanced in the direction of the drilling axis 8 in the upwardly pivoted position, i.e. in the drilling position. The starting height is secured relative to the carriage 10 by a stop 26 or can be actively displaced by the aid of a displacement drive 27. Laterally on the exterior of the starter pipe 7 are attached axially extendible supporting means 16 and 17, which serve to axially brace the starter pipe 7, as will be explained in more detail below. A drilling device, whose drill head 18 is apparent from FIG. 1, is received in the interior of the starter pipe 7.

Departing from the starting position represented in FIG. 1, the starter pipe 7 can then be brought into the drilling position illustrated in FIG. 2, this being effected by a combined pivotal and displacement movement of the starter pipe 7 in order to optimally account for the restricted space conditions provided within the increased excavation 9. To reach the drilling position illustrated in FIG. 2, the carriage 10 was advanced as far as to near the front end of the base frame 5 while simultaneously pivoting the starter pipe 7 upwards about the pivot axis 13. The cylinder piston unit provided for the displacement of the carriage 10 is denoted by 19. After having reached the position illustrated in FIG. 2, the starter pipe 7 can be brought even more closely to the roof by advancing the starter pipe 7 relative to the guide frame 15 in the direction to the roof together with the support element 17.

To support the starter pipe 7, the support element 17 is extended in the axial direction, with a support shoe 20 being supported on the base frame 5. Several supporting props 21, which serve the support against the lateral face, depart from the support shoe 20. Subsequently, also the prop 22 of the support element 16 is axially extended from the position illustrated in FIG. 2 and pressed against the roof. Departing from the thus stabilized starter pipe 7, the drilling device is advanced in the sense of arrow 23.

The starter car 1 is again clearly illustrated in side view in FIG. 3, in which the previously used reference numerals have been retained. In the top view according to FIG. 4, additional, laterally extendible support feet 25 are to be seen besides the support feet 24 of the main frame 2. Apart from that, FIGS. 3 to 5 correspond to the configuration according to FIGS. 1 and 2.

The invention claimed is:

1. A starter car for a drilling device for mining underground deposits, comprising:

a base frame (5) mounted to rotate about a vertical axis (6), and a starter pipe (7) mounted to pivot about a substantially horizontal pivot axis (13) and arranged to receive the drilling device, wherein the starter pipe (7) is arranged to be displaceable relative to the base frame (5) transversely to the horizontal pivot axis (13) in a generally horizontal plane; and, the starter pipe (7) comprises axially extendible support elements (16, 17) mounted to be extendible in an axial direction of the starter pipe (7) to brace the starter pipe (7) within a road.

2. A starter car according to claim 1, wherein the starter pipe (7) is pivotally fixed to a carriage (10), and the carriage (10) is displaceable transversely to the horizontal pivot axis (13).

3. A starter car according to claim 2, wherein the starter pipe (7) is guided in a pivotally mounted guide frame (15) so as to be displaceable transversely to the horizontal pivot axis (13).

4. A starter car according to claim 2, wherein the substantially horizontal pivot axis (13) extends below a horizontal central plane of the starter pipe (7).

5. A starter car according to claim 2, wherein the base frame (5) is rotationally mounted on a movable main frame (2).

6. A starter car according to claim 1, wherein the starter pipe (7) is guided in a pivotally mounted guide frame (15) so as to be displaceable transversely to the horizontal pivot axis (13).

7. A starter car according to claim 6, wherein the starter pipe (7) is pivotally fixed to a carriage (10), the carriage (10) is displaceable transversely to the horizontal pivot axis (13), and the guide frame (15) is pivotally mounted on the carriage (10).

8. A starter car according to claim 7, wherein a pivot drive (14) for pivoting the starter pipe (7) engages at the carriage (10).

9. A starter car according to claim 7, wherein the substantially horizontal pivot axis (13) extends below a horizontal central plane of the starter pipe (7).

10. A starter car according to claim 6, wherein the substantially horizontal pivot axis (13) extends below a horizontal central plane of the starter pipe (7).

11. A starter car according to claim 6, wherein the base frame (5) is rotationally mounted on a movable main frame (2).

12. A starter car according to claim 1, wherein the substantially horizontal pivot axis (13) extends below a horizontal central plane of the starter pipe (7).

13. A starter car according to claim 12, wherein a pivot drive (14) for pivoting the starter pipe (7) engages at a carriage (10).

14. A starter car according to claim 1, wherein the base frame (5) is rotationally mounted on a movable main frame (2).

15. A starter car according to claim 14, wherein the movable main frame (2) comprises laterally extendible support elements (25) mounted for vertical support of the starter car.

16. A starter car according to claim 1, wherein a first one of the axially extendible support elements (16) is mounted to be adjustable to abut against a roof, and a second one of the axially extendible support elements (17) is mounted to be adjustable to abut against the base frame (5).

17. A starter car according to claim 1, wherein at least one of the axially extendible support elements (16, 17) comprises supporting struts (21) mounted so as to be foldable out laterally and pressable against a lateral face.

18. A starter car according to claim 1, wherein the starter pipe (7) is pivotally fixed to a carriage (10), the carriage (10) is displaceable transversely to the horizontal pivot axis (13), the starter pipe (7) is guided in a pivotally mounted guide frame (15) so as to be displaceable transversely to the horizontal pivot axis (13), the guide frame (15) is pivotally mounted on the carriage (10), the substantially horizontal pivot axis (13) extends below a horizontal central plane of the starter pipe (7), a pivot drive (14) for pivoting the starter pipe (7) engages at the carriage (10), the base frame (5) is rotationally mounted on a movable main frame (2), the movable main frame (2) comprises laterally extendible support elements (25) mounted for vertical support of the starter car, a first one of the axially extendible support elements (16) is mounted to be adjustable to abut against a roof, and a second one of the axially extendible support elements (17) is mounted to be adjustable to abut against the base frame (5), and at least one of the axially extendible support elements (16, 17) comprises supporting struts (21) mounted so as to be foldable out laterally and pressable against a lateral face.

* * * * *